US010013945B2

(12) United States Patent
Jung et al.

(10) Patent No.: US 10,013,945 B2
(45) Date of Patent: *Jul. 3, 2018

(54) LIQUID CRYSTAL DISPLAY AND DRIVING METHOD THEREOF

(71) Applicant: Samsung Display Co., Ltd., Yongin-si (KR)

(72) Inventors: Jin-Soo Jung, Hwaseong-si (KR); Suk Hoon Kang, Seoul (KR); Jong Hwan Jeon, Gwangju-si (KR); In Ok Kim, Osan-si (KR); Jun Woo Lee, Seongnam-si (KR); Baek Kyun Jeon, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/402,919

(22) Filed: Jan. 10, 2017

(65) Prior Publication Data

US 2017/0148411 A1 May 25, 2017

Related U.S. Application Data

(63) Continuation of application No. 14/801,402, filed on Jul. 16, 2015, now Pat. No. 9,558,703.

(30) Foreign Application Priority Data

Dec. 29, 2014 (KR) ..... 10-2014-0192262

(51) Int. Cl.
*G09G 3/36* (2006.01)

(52) U.S. Cl.
CPC ..... *G09G 3/3696* (2013.01); *G09G 3/3655* (2013.01); *G09G 3/3688* (2013.01);
(Continued)

(58) Field of Classification Search
CPC ..... G09G 2320/041; G09G 3/3677; G09G 3/3688; G09G 3/3655; G09G 3/3696;
(Continued)

(56) References Cited

U.S. PATENT DOCUMENTS 5,754,150 A 5/1998 Matsui
6,063,829 A 5/2000 Endou et al.
(Continued)

FOREIGN PATENT DOCUMENTS

JP 3893659 3/2007
JP 4504665 7/2010
(Continued)

OTHER PUBLICATIONS

European Search Report dated Apr. 26, 2016 in European Patent Application No. 15190325.9.
(Continued)

*Primary Examiner* — Koosha Sharifi-Tafreshi
(74) *Attorney, Agent, or Firm* — H.C. Park & Associates, PLC

(57) ABSTRACT

Among data voltages applied to a plurality of pixels on a display panel, a first data voltage is shifted from a first original data voltage by a first value, a second data voltage is shifted from a second original data voltage by a second value, and a third data voltage is shifted from a third original data voltage by a third value to compensate for AC and DC afterimages. A common voltage generator provides an optimal common voltage for the third data voltage when the temperature of the liquid crystal panel assembly is lower than a reference temperature and provides an optimal common voltage for the first data voltage or the second data voltage when the temperature of the liquid crystal panel assembly is higher than or equal to the reference temperature. The first, second, and third values correspond to
(Continued)

respective kickback voltages of the respective gray level data voltages.

15 Claims, 17 Drawing Sheets

(52) U.S. Cl.
CPC ..... *G09G 2310/0289* (2013.01); *G09G 2320/0276* (2013.01); *G09G 2320/041* (2013.01); *G09G 2330/12* (2013.01)

(58) Field of Classification Search
CPC ... G09G 2310/0243; G09G 2320/0276; G09G 2320/06; G09G 2320/0673; G09G 2320/0204; G09G 2320/0247
USPC ..... 345/55, 87, 94, 101
See application file for complete search history.

(56) References Cited

U.S. PATENT DOCUMENTS

2004/0041778 A1 3/2004 Hiraki et al.
2009/0040163 A1* 2/2009 Sun ..... G09G 3/3696 345/98
2009/0315872 A1 12/2009 Ikeda et al.
2011/0227955 A1* 9/2011 Lee ..... G09G 3/3648 345/690
2014/0022225 A1 1/2014 Lee et al.
2014/0111499 A1* 4/2014 Jang ..... G09G 3/3696 345/212
2016/0149574 A1* 5/2016 Cui ..... H03K 19/00369 327/513

FOREIGN PATENT DOCUMENTS

JP 2012-189764 10/2012
KR 10-2008-0062874 7/2008
KR 10-2008-0045387 2/2010
KR 10-2010-0019246 2/2010

OTHER PUBLICATIONS

Notice of Allowance dated Sep. 22, 2016, in U.S. Appl. No. 14/801,402.

* cited by examiner

LIQUID CRYSTAL DISPLAY AND DRIVING METHOD THEREOF

CROSS-REFERENCE TO RELATED APPLICATION

This application is a Continuation of U.S. patent application Ser. No. 14/801,402, filed on Jul. 16, 2015, which claims priority from and the benefit of Korean Patent Application No. 10-2014-0192262 filed on Dec. 29, 2014, each of which is hereby incorporated by reference for all purposes as if fully set forth herein.

BACKGROUND

Field

Exemplary embodiments of the present invention relate a liquid crystal display and a driving method, and more particularly, to a liquid crystal display and a driving method with an improved afterimage.

Discussion of the Background

A liquid crystal display (LCD), which is one of the most common types of display devices currently in use, includes two display panels with electrodes and a liquid crystal layer interposed therebetween. The liquid crystal display generates an electric field by applying a voltage to the electrodes to realign liquid crystal molecules of the liquid crystal layer and thus, control transmittance of light so as to display images.

The liquid crystal display includes thin film transistors, a gate line and a data line which cross each other are formed on the display panel of the liquid crystal display including the thin film transistors, and a pixel corresponding to an area in which a screen is displayed is connected to the thin film transistor.

When the thin film transistor is turned on by applying a gate-on voltage to the gate line, a data voltage applied through the data line is charged in the pixel. The alignment state of the liquid crystal layer is determined depending on the electric field formed between a pixel voltage charged in the pixel and a common voltage applied to a common electrode. The data voltage may be applied by varying a polarity for each frame.

The data voltage applied to the pixel is shifted by a parasitic capacitance Cgs between a gate electrode and a source electrode to form the pixel voltage. In this case, the shifted voltage is referred to as a kickback voltage.

The value of the kickback voltage is changed according to a gray level and a polarity of the data voltage so that the pixel voltage varies for every frame. As a result, a flicker defect due to a luminance difference occurs, and there is a problem in that the liquid crystal layer is influenced by a residual DC voltage to form an afterimage. In order to solve a DC afterimage due to the residual DC voltage and the like, an asymmetrical gamma correction method in which the data voltage is compensated for each gray level and the like have been attempted, but separately, an AC afterimage then becomes a problem.

The above information disclosed in this Background section is only for enhancement of understanding of the background of the invention and therefore it may contain information that does not form the prior art that is already known in this country to a person of ordinary skill in the art.

SUMMARY

Exemplary embodiments of the present invention present invention provide a liquid crystal display and a driving method having advantages of improving an AC afterimage at room temperature and at a high temperature.

Additional features of the invention will be set forth in the description which follows, and in part will be apparent from the description, or may be learned by practice of the invention.

An exemplary embodiment of the present invention discloses a liquid crystal display including: a liquid crystal panel assembly including a plurality of pixels; a signal controller generating image data signals so that among the data voltages applied to the plurality of pixels, a first data voltage is shifted from a first original data voltage by a first value, a second data voltage is shifted from a second original data voltage by a second value, and a third data voltage is shifted from a third original data voltage by a third value; a data driver applying the data voltage to a plurality of data lines connected to the plurality of pixels; and a common voltage generator providing an optimal common voltage for the third data voltage when the temperature of the liquid crystal panel assembly is lower than a reference temperature and providing an optimal common voltage for the first data voltage or the second data voltage to the liquid crystal panel assembly when the temperature of the liquid crystal panel assembly is higher than or equal to the reference temperature.

An exemplary embodiment of the present invention also discloses a driving method of a liquid crystal display including: shifting a first data voltage from a first original data voltage by a first value, shifting a second data voltage from a second original data voltage by a second value, and shifting a third data voltage from a third original data voltage by a third value, among data voltages applied to a plurality of pixels; measuring a temperature of a liquid crystal panel assembly including the plurality of pixels; determining whether the temperature of the liquid crystal panel assembly is lower than a reference temperature; generating an optimal common voltage of the third data voltage when the temperature of the liquid crystal panel assembly is lower than the reference temperature; and generating an optimal common voltage for the first data voltage or the second data voltage when the temperature of the liquid crystal panel assembly is higher than or equal to the reference temperature.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
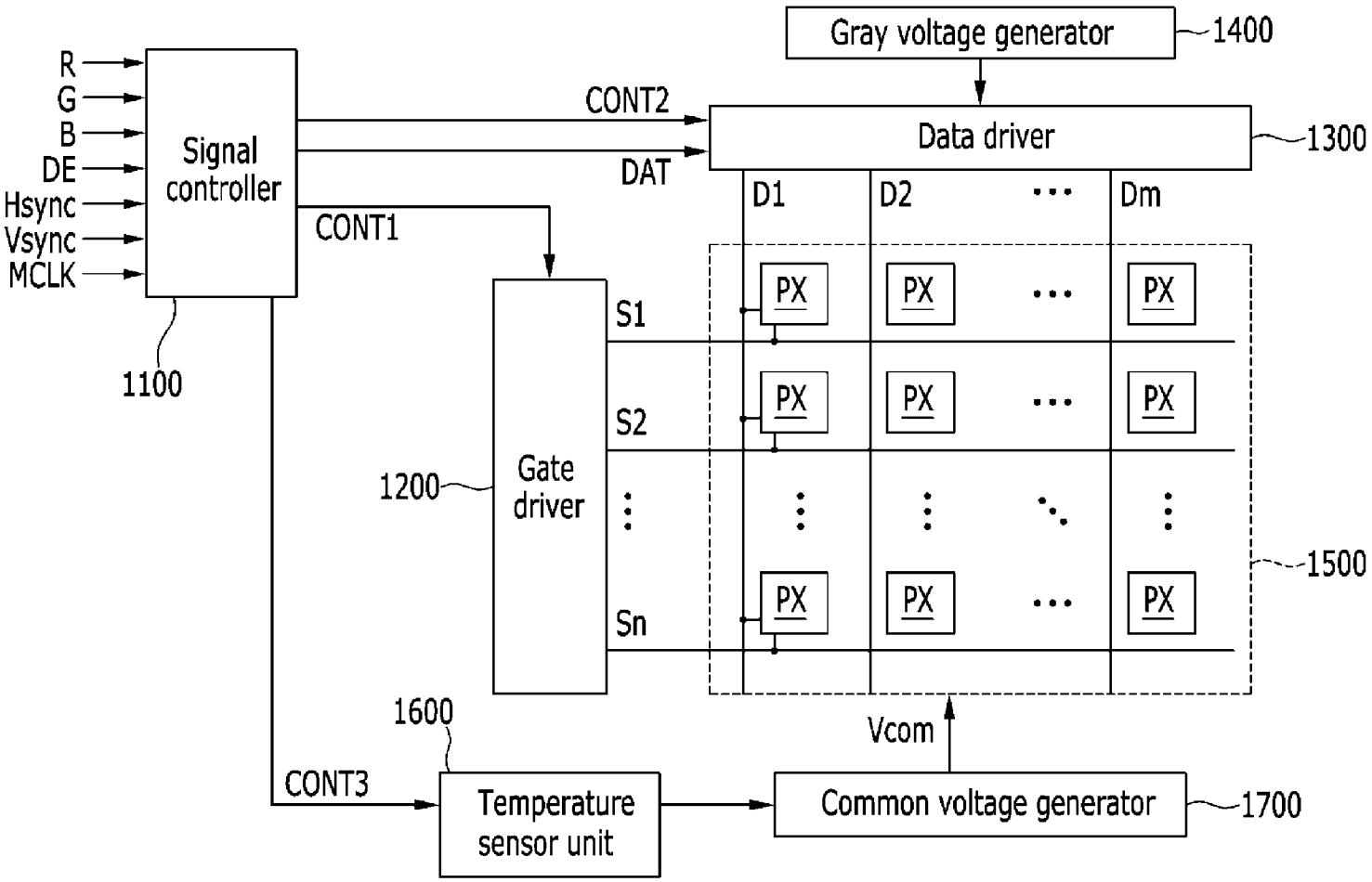
FIG. 1 is a block diagram illustrating a liquid crystal display according to an exemplary embodiment of the present invention.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Various exemplary embodiments are described herein with reference to sectional illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

FIG. 1 is a block diagram of a liquid crystal display according to an exemplary embodiment of the present invention.

Referring to FIG. 1, a liquid crystal display includes a signal controller 1100, a gate driver 1200, a data driver 1300, a gray voltage generator 1400, a liquid crystal panel assembly 1500, a temperature sensor unit 1600, and a common voltage generator 1700.

The liquid crystal panel assembly 1500 includes a plurality of gate lines S1-Sn, a plurality of data lines D1-Dm, and a plurality of pixels PX. The plurality of pixels PX may be connected to the plurality of gate lines S1-Sn and the plurality of data lines D1-Dm to be arranged substantially in a matrix form. The plurality of gate lines S1-Sn may be extended substantially in a row direction to be substantially parallel to each other. The plurality of data lines D1-Dm may be extended substantially in a column direction to be substantially parallel to each other. Here, it is illustrated that only the plurality of gate lines S1-Sn and the plurality of data lines D1-Dm may be connected to the plurality of pixels PX, but various signal lines such as a power line and a storage electrode line may be additionally connected to the plurality of pixels PX according to a structure of the pixel PX or a driving method.

Meanwhile, a backlight (not shown) may be provided on a rear surface of the liquid crystal panel assembly 1500 to control luminance of an image displayed on the liquid crystal panel assembly 1500. The backlight emits light to the liquid crystal panel assembly 1500.

The signal controller 1100 receives image signals R, G, and B and an input control signal. The image signals R, G, and B store luminance information of the plurality of pixels. The luminance has a predetermined number, for example, $1024(=2^{10})$, $256(=2^{8})$ or $64(=2^{6})$, of levels of gray. The input control signal may include a data enable signal DE, a horizontal synchronization signal Hsync, a vertical synchronization signal Vsync, and/or a main clock signal MCLK.

The signal controller 1100 generates a gate control signal CONT1, a data control signal CONT2, and an image data signal DAT according to the image signal R, G, and B, the data enable signal DE, the horizontal synchronization signal Hsync, the vertical synchronization signal Vsync, and the main clock signal MCLK. The signal controller 1100 may generate an image data signal DAT by dividing the image signals R, G, and B by a frame unit according to the vertical synchronization signal Vsync and dividing the image signals R, G, and B by a gate line unit according to the horizontal synchronization signal Hsync. In this case, the signal controller 1100 corrects the image signals R, G, and B according to a method of optimizing the data voltage (described below in FIG. 9) to generate an image data signal DAT.

The signal controller 1100 provides the image data signal DAT and the data control signal CONT2 to the data driver 1300. The data control signal CONT2 may be a signal controlling an operation of the data driver 1300 and may include a horizontal synchronization start signal STH notifying the transmission start of the image data signal DAT, a load signal LOAD instructing the output of the data signal to the data lines D1-Dm, and/or a data clock signal HCLK. The data control signal CONT2 may further include a reverse signal RVS for inverting a voltage polarity of the image data signal DAT for the common voltage Vcom.

The signal controller 1100 provides the gate control signal CONT1 to the gate driver 1200. The gate control signal CONT1 includes at least one clock signal controlling the output of the scanning start signal STV and the gate-on voltage from the gate driver 1200. The gate control signal CONT1 may further include an output enable signal OE limiting the duration of the gate-on voltage.

The signal controller 1100 verifies afterimage driving and may generate a temperature control signal CONT3 when the afterimage driving is verified. Afterimage driving means that the same image is displayed for a predetermined time or more on the entire surface or a predetermined region of the liquid crystal display. The signal controller 1100 stores and compares the received image signals R, G, and B for a predetermined time to verify whether the afterimage driving exists. The signal controller 1100 provides the temperature control signal CONT3 to the temperature sensor unit 1600. This function of verifying the afterimage driving of the signal controller 1100 and generating the temperature control signal CONT3 may also be omitted without departing from the scope of the exemplary embodiments.

The gate driver 1200 may be connected to the plurality of gate lines S1-Sn and applies a gate signal, which is configured by combining a gate-on voltage and a gate-off voltage which turns on and turns off a switching element Q (see FIG. 2) connected to the gate lines S1-Sn of the liquid crystal panel assembly 1500, respectively, to the plurality of gate lines S1-Sn.

The data driver 1300 may be connected to the data lines D1-Dm of the liquid crystal panel assembly 1500 and selects a gray voltage from the gray voltage generator 1400. The data driver 1300 applies the selected gray voltage to the data lines D1-Dm as the data voltage. The gray voltage generator 1400 may provide only a predetermined number of reference gray voltages without providing voltages for all gray levels. In this case, the data driver 1300 may divide the reference gray voltage to generate gray voltages for all of the gray levels and select the data voltages among the generated gray voltages.

A difference between the data voltage applied to the pixel PX and the common voltage Vcom is represented as a charging voltage of a liquid crystal capacitor CLC (see FIG. 2), that is, a pixel voltage. The alignment of the liquid crystal molecules varies according to a size of the pixel voltage, and as a result, the polarization of light passing through the liquid crystal layer 3 may be changed. The change in the polarization may be represented as a change in transmittance of the light by a polarizer, and as a result, the pixel PX displays luminance expressed by gray levels of the image signals R, G, and B.

The gate signals of the gate-on voltages may be sequentially applied to the plurality of gate lines S1-Sn by setting 1 horizontal period as a unit. Data voltages may be applied to the plurality of data lines D1-Dm corresponding to the gate signals of the gate-on voltages, and as a result, the data voltages may be applied to all the pixels PX to display images in one frame. The 1 horizontal period is referred to as '1H' and the same as one period of the horizontal synchronization signal Hsync and the data enable signal DE.

When one frame ends, the next frame starts and a state of the reverse signal RVS applied to the data driver 1300 is controlled so that the polarity of the data voltage applied to each pixel PX is opposite to the polarity in the previous frame ("frame inversion"). In this case, even in one frame, according to a characteristic of the reverse signal RVS, a polarity of the data voltage applied to one data line is periodically changed (i.e., row inversion and dot inversion), or polarities of data voltages applied to one pixel row may be different from each other (i.e., column inversion and dot inversion). The data voltage may be divided into a positive data voltage and a negative data voltage according to a polarity. The positive data voltage for the same gray level may be higher than the negative data voltage.

The temperature sensor unit 1600 measures a temperature of the liquid crystal panel assembly 1500 and may provide the measured temperature to the common voltage generator 1700. The temperature sensor unit 1600 may measure the temperature of the liquid crystal panel assembly 1500 according to the temperature control signal CONT3.

The common voltage generator 1700 generates the common voltage Vcom provided to the liquid crystal panel assembly 1500. The common voltage generator 1700 generates a first common voltage 1st Vcom when the temperature measured by the temperature sensor unit 1600 is lower than a reference temperature to provide the generated first common voltage to the liquid crystal panel assembly 1500. In addition, the common voltage generator 1700 generates a second common voltage 2nd Vcom when the temperature measured by the temperature sensor unit 1600 is higher than or equal to the reference temperature to provide the generated second common voltage to the liquid crystal panel assembly 1500. The first common voltage 1st Vcom may be an optimal common voltage for a maximum gray level (a white gray) in asymmetrical gamma correction of FIG. 9 to be described below, and the second common voltage 2nd Vcom may be an optimal common voltage for a halftone gray level or a minimum gray level (a black gray). The halftone gray level includes gray levels between the maximum gray level and the minimum gray level. The second common voltage 2nd Vcom may be set to a high voltage by a dummy value at the optimal common voltage for the maximum gray level.

A case where the temperature of the liquid crystal panel assembly 1500 is lower than the reference temperature may mean a room temperature, and a case where the temperature of the liquid crystal panel assembly 1500 is higher than or equal to the reference temperature may mean a high temperature. The reference temperature may be set to approximately 40° C. However, this reference temperature is not limited, and the reference temperature dividing the room (or low) temperature and the high temperature may be determined in various manners without departing from the scope of the exemplary embodiments.

The liquid crystal display according to an exemplary embodiment of the present invention corrects the image signals R, G, and B according to a process of optimizing the data voltage applied to the pixel by the asymmetrical gamma correction (to be described below in FIG. 9) to generate the image data signal DAT, thereby reducing a primary room temperature afterimage and a high temperature afterimage. In addition, the common voltage generator 1700 selectively generates the first common voltage 1st Vcom and the second common voltage 2nd Vcom according to the temperature of the liquid crystal panel assembly 1500 to provide the generated common voltage to the liquid crystal panel assembly 1500, thereby reducing a secondary room temperature afterimage. This will be described below in reference to FIGS. 10 to 15.

Each of the signal controller 1100, the gate driver 1200, the data driver 1300, the gray voltage generator 1400, the temperature sensor unit 1600, and the common voltage generator 1700 described above may be directly mounted on the liquid crystal panel assembly 1500 in the form of at least one IC chip, mounted on a flexible printed circuit film (not illustrated), attached to the liquid crystal panel assembly 1500 in the form of a tape carrier package (TCP), or mounted on a separate printed circuit board (not illustrated). Alternatively, the signal controller 1100, the gate driver 1200, the data driver 1300, the gray voltage generator 1400, the temperature sensor unit 1600, and the common voltage generator 1700 may be integrated on the liquid crystal panel assembly 1500 together with the signal lines S1-Sn and D1-Dm.

Figure 2:
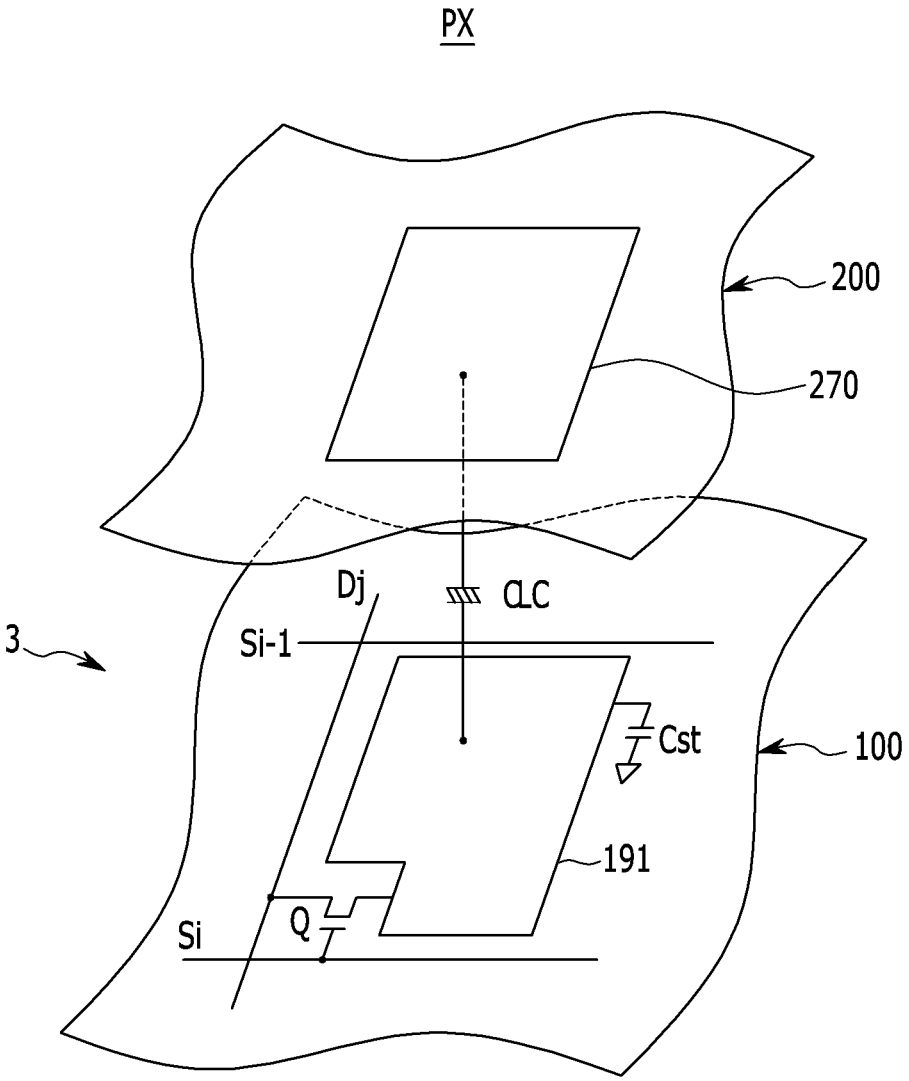
FIG. 2 is a circuit diagram illustrating an equivalent circuit of one pixel in the liquid crystal display according to an exemplary embodiment of the present invention.

FIG. 2 is a circuit diagram illustrating an equivalent circuit of one pixel in the liquid crystal display according to the exemplary embodiment of the present invention.

Referring to FIG. 2, one pixel PX included in the liquid crystal panel assembly 1500 will be described. A pixel PX connected to an i-th gate line Si and a j-th data line Dj ($1 \le i \le n$, $1 \le j \le m$) will be described as an example. The pixel PX includes a switching element Q, and a liquid crystal capacitor CLC and a storage capacitor Cst connected thereto.

The switching element Q may be a three-terminal element such as a thin film transistor provided on a lower panel 100. The switching element Q includes a gate terminal connected to the gate lines S1-Sn, an input terminal connected to the data lines D1-Dm, and an output terminal connected to the liquid crystal capacitor CLC and the storage capacitor Cst. The thin film transistor includes amorphous silicon or polycrystalline silicon.

Meanwhile, the thin film transistor may be an oxide thin film transistor (oxide TFT) in which a semiconductor layer is configured by an oxide semiconductor.

The oxide semiconductor material may include any one of oxides based on titanium (Ti), hafnium (Hf), zirconium (Zr), aluminum (Al), tantalum (Ta), germanium (Ge), zinc (Zn), gallium (Ga), tin (Sn), or indium (In), and zinc oxide (ZnO), indium-gallium-zinc oxide (InGaZnO4), indium-zinc oxide (Zn—In—O), zinc-tin oxide (Zn—Sn—O), indium-gallium oxide (In—Ga—O), indium-tin oxide (In—Sn—O), indium-zirconium oxide (In—Zr—O), indium-zirconium-zinc oxide (In—Zr—Zn—O), indium-zirconium-tin oxide (In—Zr—Sn—O), indium-zirconium-gallium oxide (In—Zr—Ga—O), indium-aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium-tantalum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium-germanium-gallium oxide (In—Ge—Ga—O), titanium-indium-zinc oxide (Ti—In—Zn—O), or hafnium-indium-zinc oxide (Hf—In—Zn—O) which are complex oxides thereof.

The semiconductor layer may include a channel region in which impurities are not doped, and a source region and a drain region formed at two sides of the channel region, in which impurities are doped. Herein, the impurities vary according to a kind of thin film transistor, and may be N-type impurities or P-type impurities.

In the case where the semiconductor layer is formed of the oxide semiconductor, in order to protect the oxide semiconductor vulnerable to an external environment such as exposure to a high temperature, a separate passivation layer may be added.

The liquid crystal capacitor CLC uses a pixel electrode 191 and a common electrode 270 of the lower panel 100 as two terminals, and a liquid crystal layer 3 between the pixel electrode 191 and the common electrode 270 functions as a dielectric material. The liquid crystal layer 3 has dielectric anisotropy. A pixel voltage may be formed by a voltage difference between the pixel electrode 191 and the common electrode 270.

The pixel electrode 191 may be connected to the switching element Q. The common electrode 270 receives a common voltage Vcom. The common electrode 270 may be disposed on the entire surface of the upper panel 200. Unlike those illustrated in FIG. 2, the common electrode 270 may be disposed on the lower panel 100, and in this case, at least one of the pixel electrode 191 and the common electrode 270 may be formed in a linear shape or a rod shape.

The storage capacitor Cst which plays a subordinate role of the liquid crystal capacitor CLC is formed by overlapping a separate signal line (not illustrated) included in the lower panel 100 and the pixel electrode 191 with an insulator therebetween, and a predetermined voltage such as a common voltage Vcom may be applied to the separate signal line.

A color filter (not illustrated) may be formed on the upper panel 200. Alternatively, the color filter may also be formed on or below the pixel electrode 191 of the lower panel 100. Each pixel PX may uniquely display one of the primary colors, and a desired color may be recognized by a spatial sum of the primary colors. Each pixel PX alternately displays the primary colors with time, and a desired color may be recognized by a temporal sum of the primary colors. An example of the primary colors may include three primary colors of red, green, and blue.

Figure 3:
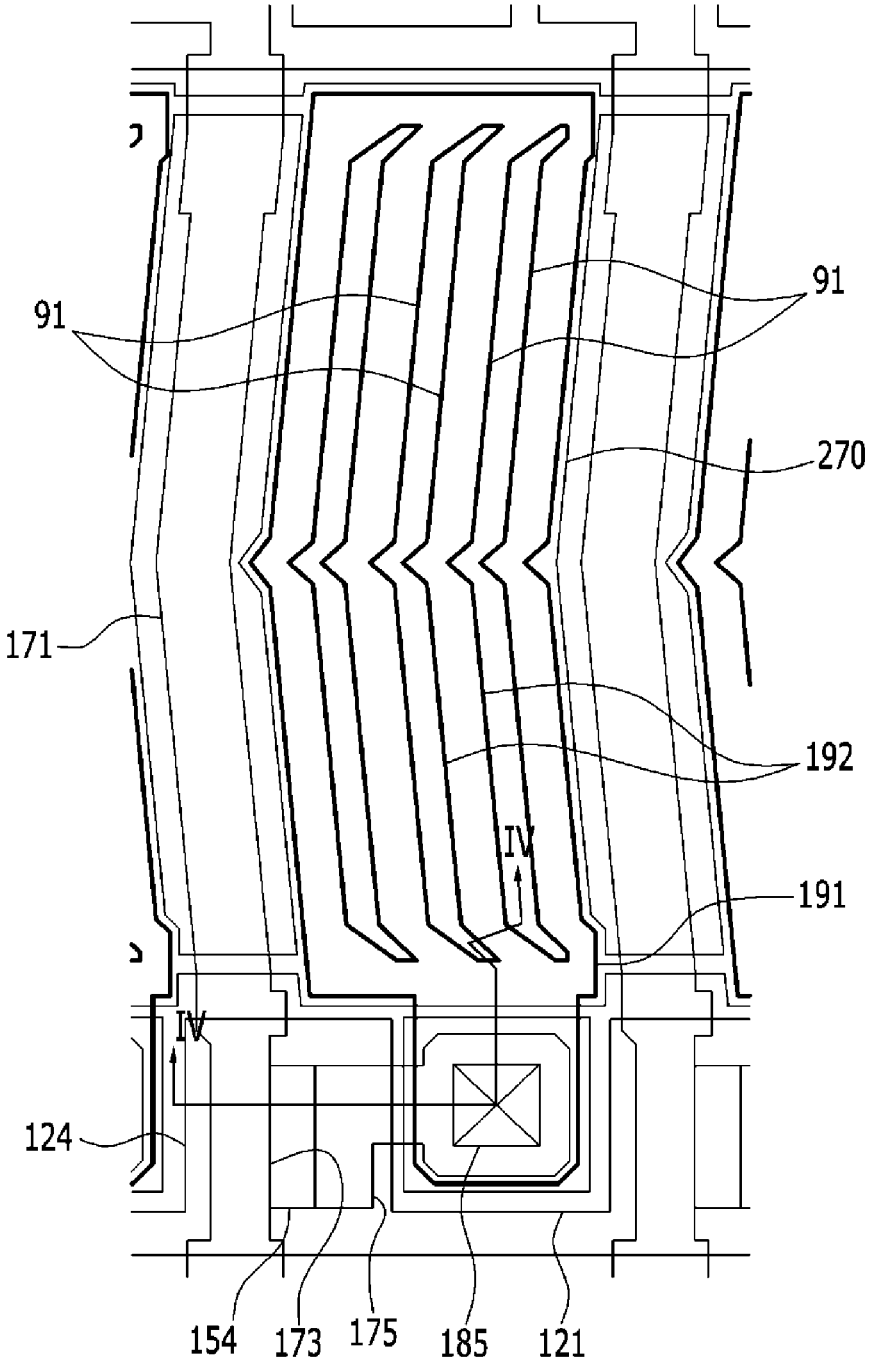
FIG. 3 is a plan view illustrating one pixel in the liquid crystal display according to an exemplary embodiment of the present invention.
Figure 4:
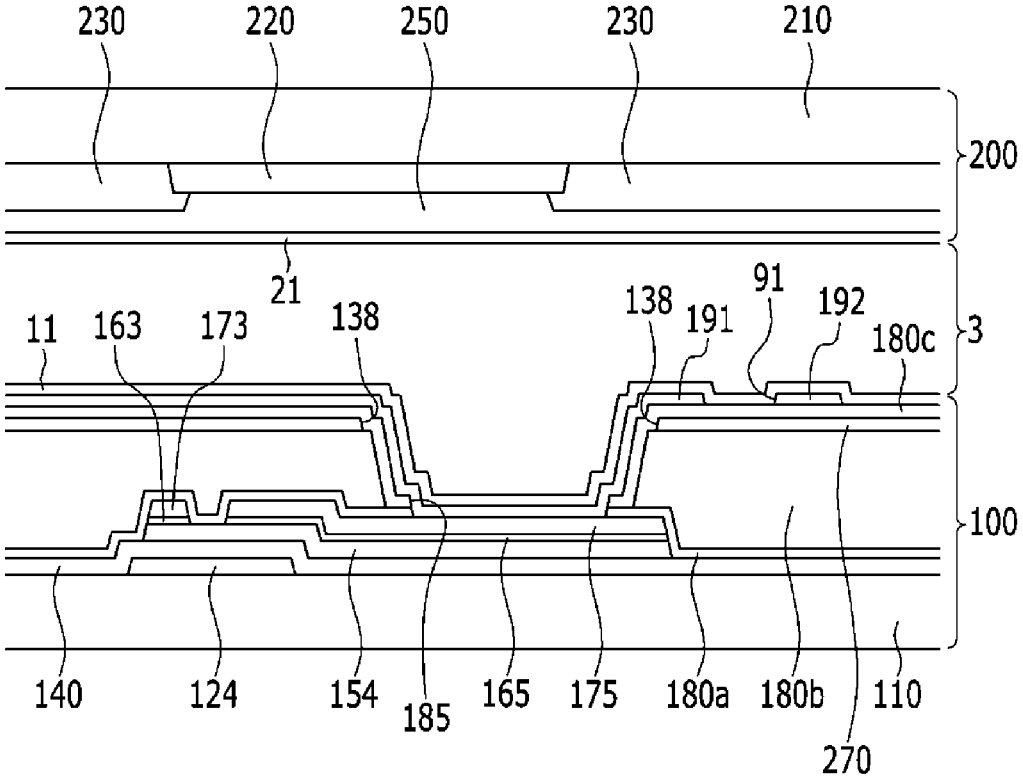
FIG. 4 is a cross-sectional view of FIG. 3 taken along line IV-IV.

FIG. 3 is a plan view illustrating one pixel in the liquid crystal display according to an exemplary embodiment of the present invention. FIG. 4 is a cross-sectional view of FIG. 3 taken along line IV-IV.

Referring to FIGS. 3 and 4, the liquid crystal display according to the exemplary embodiment includes a lower panel 100 and an upper panel 200, and a liquid crystal layer 3 injected therebetween.

First, the lower panel 100 will be described.

A gate conductor including the gate line 121 is formed on a first substrate 110 made of transparent glass, plastic, or the like.

The gate line 121 includes a gate electrode 124 and a wide end portion (not illustrated) for connecting with other layers or an external driving circuit. The gate line 121 may be made of aluminum-based metal such as aluminum (Al) or an aluminum alloy, silver-based metal such as silver (Ag) or a silver alloy, copper-based metal such as copper (Cu) or a copper alloy, molybdenum-based metal such as molybdenum (Mo) or a molybdenum alloy, chromium (Cr), tantalum (Ta), and titanium (Ti). However, the gate line 121 may have a multilayer structure including at least two conductive layers having different physical properties.

A gate insulating layer 140 made of silicon nitride ($SiN_x$) or silicon oxide (SiOx) may be formed on the gate line 121. The gate insulating layer 140 may have a multilayer structure including at least two insulating layers having different physical properties.

A semiconductor layer 154 made of amorphous silicon or polysilicon may be formed on the gate insulating layer 140. The semiconductor layer 154 may include an oxide semiconductor.

Ohmic contacts 163 and 165 may be formed on the semiconductor layer 154. The ohmic contacts 163 and 165 may be made of a material such as n+ hydrogenated amorphous silicon in which an N-type impurity such as phosphorus (P) is doped at a high concentration or silicide. The ohmic contacts 163 and 165 may be disposed on the semiconductor layer 154 to make a pair. When the semiconductor layer 154 is an oxide semiconductor, the ohmic contacts 163 and 165 may be omitted.

On the ohmic contacts 163 and 165 and the gate insulating layer 140, a data conductor including a data line 171 including a source electrode 173 and a drain electrode 175 may be formed.

The data line 171 may include a wide end portion (not illustrated) for connecting with other layers or an external driving circuit. The data line 171 transfers a data signal and mainly extends in a vertical direction to cross the gate line 121.

In this case, the data line 171 may have a first curved portion having a bent shape in order to obtain maximum transmittance of the liquid crystal display, and the curved portions meet each other in a middle region of the pixel area to have a V shape. In the middle region of the pixel area, a second curved portion curved to form a predetermined angle with the first curved portion may be further included.

The source electrode 173 may be a part of the data line 171 and disposed on the same line as the data line 171. The drain electrode 175 may be formed to extend in parallel to the source electrode 173. Accordingly, the drain electrode 175 may be parallel to a part of the data line 171.

The gate electrode 124, the source electrode 173, and the drain electrode 175 form one thin film transistor (TFT) together with the semiconductor layer 154, and a channel of the thin film transistor may be formed at the semiconductor layer 154 portion between the source electrode 173 and the drain electrode 175.

The liquid crystal display according to an exemplary embodiment of the present invention may include the source electrode 173 positioned on the same line as the data line 171 and the drain electrode 175 extending in parallel to the data line 171 to increase a width of the thin film transistor without increasing an area occupied by the data conductor, and as a result, an aperture ratio of the liquid crystal display may be increased.

The data line 171 and the drain electrode 175 may be made of refractory metal, such as molybdenum, chromium, tantalum, and titanium or alloys thereof and have a multilayer structure including a refractory metal layer (not illustrated) and a low resistive conductive layer (not illustrated). An example of the multilayer structure may include a double layer of a molybdenum (alloy) lower layer and an aluminum (alloy) upper layer, and a triple layer of a molybdenum (alloy) lower layer, an aluminum (alloy) intermediate layer, and a molybdenum (alloy) upper layer.

A first passivation layer 180*a* may be disposed on data conductors 171, 173, and 175, the gate insulating layer 140, and an exposed portion of the semiconductor layer 154. The first passivation layer 180*a* may be made of an inorganic insulating material or an organic insulating material.

A second passivation layer 180*b* may be formed on the first passivation layer 180*a*. The second passivation layer 180*b* may be made of an organic insulating material.

The second passivation layer 180*b* may be a color filter. When the second passivation layer 180*b* is the color filter, the second passivation layer 180*b* may uniquely display one of the primary colors, and an example of the primary colors may include three primary colors of red, green, and blue or yellow, cyan, and magenta. Although not illustrated, the color filter may further include a color filter which displays a mixed color of the primary colors or white in addition to the primary colors. When the second passivation layer 180*b* is the color filter, the color filter 230 may be omitted in the upper panel 200 to be described below.

A common electrode 270 may be positioned on the second passivation layer 180*b*. The common electrode 270 may be formed as a planar shape on the entire surface of the first substrate 110 as a whole body, and may have an opening 138 which is disposed in a region corresponding to a periphery of the drain electrode 175. That is, the common electrode 270 may have a plate-shaped planar shape.

The common electrodes 270 positioned in adjacent pixels may be connected to each other to receive a common voltage having a predetermined magnitude which is supplied outside the display area.

An insulating layer 180*c* may be positioned on the common electrode 270. The insulating layer 180*c* may be made of an inorganic insulating material or an organic insulating material.

The pixel electrode 191 may be positioned on the insulating layer 180*c*. The pixel electrode 191 includes a curved edge which is substantially parallel with the curved portion of the data line 171. The pixel electrode 191 has a plurality of cutouts 91 and includes a plurality of branch electrodes 192 positioned between adjacent cutouts 91.

The pixel electrode 191 is a first field generating electrode or a first electrode, and the common electrode 270 is a second field generating electrode or a second electrode. The pixel electrode 191 and the common electrode 270 may form a horizontal electric field.

A contact hole 185 exposing the drain electrode 175 is formed in the first passivation layer 180*a*, the second passivation layer 180*b*, and the insulating layer 180*c*. The pixel electrode 191 may be physically and electrically connected with the drain electrode 175 through a contact hole 185 to receive a voltage from the drain electrode 175.

A first alignment layer 11 may be formed on the pixel electrode 191 and the insulating layer 180*c*. The first alignment layer 11 may include a photo-reactive material.

In an exemplary embodiment, the first alignment layer 11 includes a copolymer of at least one of cyclobutanedianhydride (CBDA) and cyclobutanedianhydride (CBDA) derivatives and diamine. As such, a liquid crystal photo-alignment agent formed by polymerizing at least one of cyclobutanedianhydride (CBDA) and cyclobutanedianhydride (CBDA) derivatives and diamine may be formed by polymerizing at least one of cyclobutanedianhydride (CBDA) expressed by Chemical Formula 1 and cyclobutanedianhydride (CBDA) derivatives expressed by Chemical Formula 2 and diamine.

[Chemical Formula 1]

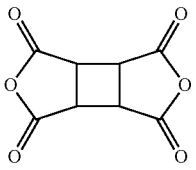

[Chemical Formula 2]

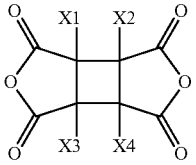

Here, in Chemical Formula 2, X1, X2, X3, and X4 are hydrogen or organic compounds, respectively, and at least one of X1, X2, X3, and X4 is not hydrogen.

In an exemplary embodiment, diamine may be aromatic diamine such as p-phenylenediamine, m-phenylenediamine, 2,5-diaminotoluene, 2,6-diaminotoluene, 4,4-diaminobiphenyl, 3,3-dimethyl-4,4-diaminobiphenyl, 3,3-dimethoxy-4,4-diaminobiphenyl, diaminodiphenyl methane, diaminodiphenyl ether, 2,2-diaminodiphenyl propane, bis(3,5-diethyl-4-aminophenyl) methane, diaminodiphenyl sulfone, diaminobenzophenone, diaminonaphthalene, 1,4-bis(4-aminophenoxy) benzene, 1,4-bis(4-aminophenyl) benzene, 9,10-bis(4-aminophenyl) anthracene, 1,3-bis(4-aminophenoxy) benzene, 4,4-bis(4-aminophenoxy) diphenylsulfone, 2,2-bis[4-(4-aminophenoxy) phenyl] propane, 2,2-bis(4-aminophenyl) hexafluoropropane, and 2,2-bis[4-(4-aminophenoxy) phenyl] hexafluoropropane, alicyclic diamine such as bis(4-aminocyclohexyl) methane and bis(4-amino-3-methylcyclohexyl) methane, aliphatic diamine such as tetramethylene diamine and hexamethylene diamine, and the like, but is not particularly limited thereto.

In an exemplary embodiment, the copolymer included in the first alignment layer 11 may include a repeating unit expressed by Chemical Formula 3, Chemical Formula 4, or Chemical Formula 5.

[Chemical Formula 3]

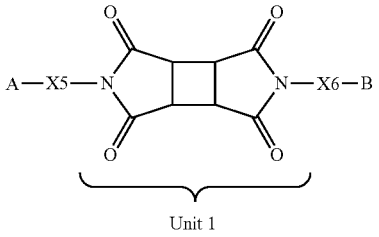

[Chemical Formula 4]

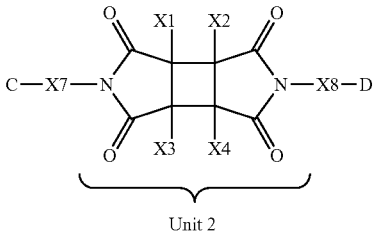

[Chemical Formula 5]

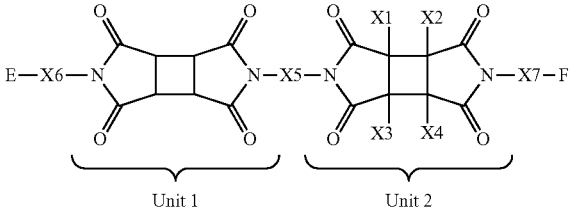

In Chemical Formulas 3 to 5, X5, X6, X7, and X8 are independently body parts coupled to two amino groups —NH2 in diamine, respectively, and A, B, C, D, E, and F are independently unit 1 or unit 2, respectively, and in Chemical Formulas 4 and 5, X1, X2, X3, and X4 are independently hydrogen, fluoride, or an organic compound, respectively, and at least one of X1, X2, X3, and X4 may not be hydrogen.

Here, a method of forming the alignment layer will be described.

A photo-alignment agent formed by polymerizing at least one of cyclobutanedianhydride (CBDA) and cyclobutanedianhydride (CBDA) derivatives and diamine is coated on the pixel electrode 191. Thereafter, the coated photo-alignment agent is baked. The baking process may be performed by two steps of pre bake and hard bake.

Thereafter, the first alignment layer 11 may be formed by irradiating polarized light to the photo-alignment agent. In this case, the irradiated light may use ultraviolet rays having a range between 240 nanometers and 380 nanometers. Preferably, ultraviolet rays of 254 nanometers may be used. In order to increase alignment, the first alignment layer 11 may be baked once more.

Next, the upper panel 200 will be described.

A light blocking member 220 may be formed on a second substrate 210 made of transparent glass, plastic, or the like. The light blocking member 220 is called a black matrix and blocks light leakage.

A plurality of color filters 230 may be formed on the second substrate 210. When the second passivation layer 180*b* of the lower panel 100 is the color filter, the color filter 230 of the upper panel 200 may be omitted. Further, the light blocking member 220 of the upper panel 200 may also be formed on the lower panel 100.

An overcoat 250 may be formed on the color filter 230 and the light blocking member 220. The overcoat 250 may be made of an (organic) insulating material and prevents the color filter 230 from being exposed to provide a flat surface. The overcoat 250 may be omitted without departing from the scope of the exemplary embodiments.

A second alignment layer 21 may be formed on the overcoat 250. The second alignment layer 21 includes a photo-reactive material. The second alignment layer 21 may be formed by the same material and method as the first alignment layer 11 described above.

The liquid crystal layer 3 may include a liquid crystal material having positive dielectric anisotropy.

The liquid crystal molecules of the liquid crystal layer 3 are aligned so that long-axial directions thereof are parallel to the display panels 100 and 200.

The pixel electrode 191 receives the data voltage from the drain electrode 175, and the common electrode 270 receives the common voltage Vcom from a common voltage applying unit disposed outside the display area.

The pixel electrode 191 and the common electrode 270 as the field generating electrodes generate the electric field, and as a result, the liquid crystal molecules of the liquid crystal layer 3 positioned on the two field generating electrodes 191 and 270 rotate in a parallel direction to the direction of the electric field. The polarization of light passing through the liquid crystal layer varies according to the determined rotation direction of the liquid crystal molecules.

As such, two field generating electrodes 191 and 270 may be formed on one lower panel 100 to enhance transmittance of the liquid crystal display and implement a wide viewing angle.

According to the liquid crystal display according to the illustrated exemplary embodiment, the common electrode 270 has a planar-shaped plane form and the pixel electrode 191 has a plurality of branch electrodes, but according to a liquid crystal display according to another exemplary embodiment of the present invention, the pixel electrode 191 has a plane form of the planar shape and the common electrode 270 may have a plurality of branch electrodes.

The present invention may be applied to all other cases where two field generating electrodes overlap with each other on the first substrate 110 with the insulating layer therebetween, the first field generating electrode formed below the insulating layer has the plane form of the planar shape, and the second field generating electrode formed on the insulating layer has the plurality of branch electrodes.

Hereinafter, afterimages of the liquid crystal display will be described with reference to FIGS. 5 and 6.

Figure 5:
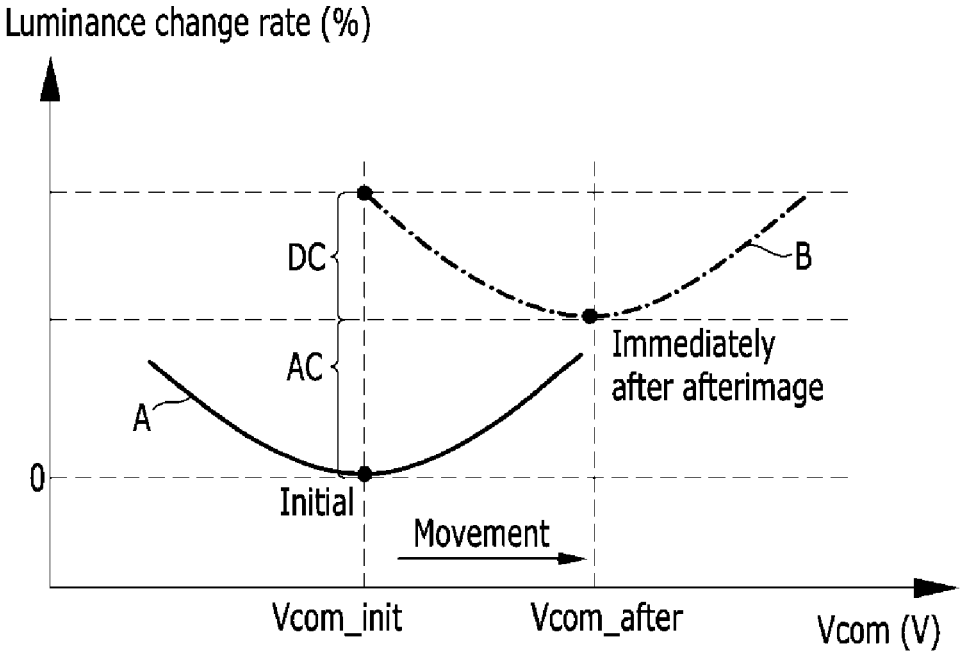
FIG. 5 is a graph for describing a method of quantifying a DC afterimage and an AC afterimage.

FIG. 5 is a graph for describing a method of quantifying a DC afterimage and an AC afterimage.

Referring to FIG. 5, afterimages generated in the liquid crystal display may be divided into a DC afterimage and an AC afterimage. The DC afterimage and the AC afterimage may be quantified by comparing a luminance change curve B for an optimal common voltage Vcom_after after the afterimage with a luminance change curve A for an initial optimal common voltage Vcom_init.

The DC afterimage means an afterimage generated when ion impurities existing in the liquid crystal layer 3 are absorbed onto the lower panel 100 or the upper panel 200 to form a residual DC voltage. The initial optimal common voltage Vcom_init is changed to the optimal common voltage Vcom_after after the afterimage by the residual DC voltage, and as a result, the luminance is changed. The DC afterimage may be quantified by a luminance increasing amount due to movement of the optimal common voltage.

The AC afterimage is generated by plastic deformation of the alignment layer. An azimuthal angle of the alignment layer is changed by the plastic deformation of the alignment layer, and as a result, the luminance is changed. The AC afterimage may be quantified by a difference between a minimum luminance value in the luminance change curve A for the initial optimal common voltage Vcom_init and a minimum luminance value in the luminance change curve B for the optimal common voltage Vcom_after after the afterimage.

Figure 6:
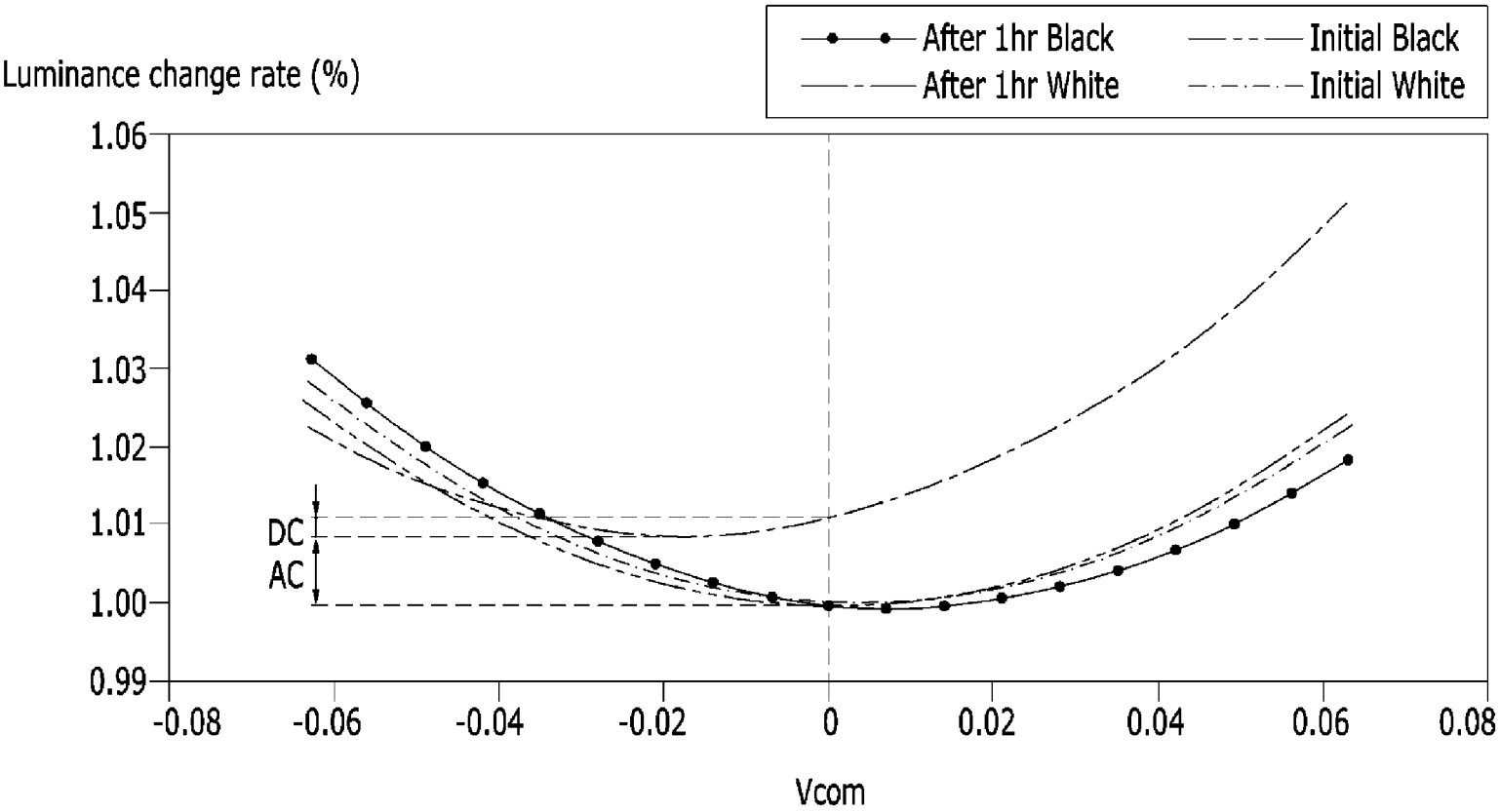
FIG. 6 is a graph of quantifying a DC afterimage and an AC afterimage in the liquid crystal display.

FIG. 6 is a graph of quantifying a DC afterimage and an AC afterimage in the liquid crystal display.

Referring to FIG. 6, like the liquid crystal display described in FIGS. 3 and 4, in an actual liquid crystal display which is a plane to line switching (PLS) mode and uses the light alignment layer, a luminance change rate for the initial common voltage and the luminance change rate for the common voltage after the afterimage were measured. That is, while the common voltage is adjusted in a state where images of a check pattern including a white pattern and a black pattern are displayed by applying the data voltages of the white (maximum gray level) and the black (minimum gray level) to the plurality of pixels in the initial stage, the luminance change rates for the white and the black were measured. In addition, while the common voltage is adjusted after the check pattern is displayed for 1 hour, the luminance change rates for the white and the black were measured.

When the DC afterimage and the AC afterimage were quantified, it was evaluated that the luminance change rate due to the AC afterimage was approximately 0.9% and the luminance change rate due to the DC afterimage was approximately 0.2%.

It can be seen that a main cause of the afterimage generated in the liquid crystal display which is the PLS mode and uses the light alignment layer is the AC afterimage rather than the DC afterimage.

A kickback voltage at which a value is changed according to a gray level and a polarity of the data voltage to vary the pixel voltage for every frame is the main cause of the DC afterimage. First, the kickback voltage will be described.

Equation 1 represents the kickback voltage.

$$Vkb = \frac{Cgs}{Clc + Cst + Cgs} \times Vd \qquad \text{(Equation 1)}$$

Here, Vkb represents a kickback voltage, Cgs represents a parasitic capacitance between the gate electrode and the source electrode of the TFT, Clc represents a liquid crystal capacitance, Cst represents a storage capacitance, and Vd represents a voltage difference between a gate-on voltage and a gate-off voltage of the gate signal.

The liquid crystal capacitance Clc may be represented like Equation 2.

$$Clc = \epsilon_0 \cdot \epsilon \cdot \frac{A}{d} \quad \text{(Equation 2)}$$

Herein, $\in_0$ represents a dielectric constant of the liquid crystal in vacuum, $\in$ represents a dielectric constant of the liquid crystal, d represents a cell gap, and A represents an overlapped area between a pixel electrode layer and a common electrode layer.

A value of the liquid crystal capacitance Clc is changed according to an alignment state of the liquid crystal. This is caused by dielectric anisotropy of the liquid crystal, and for example, in a normally black mode, a liquid crystal dielectric constant in a black state (horizontal dielectric constant, $\in$II) is smaller than a liquid crystal dielectric constant in a white state (vertical dielectric constant, $\in\perp$). Accordingly, the liquid crystal capacitance Clc in the white state is relatively larger than that in the black state, and the kickback voltage Vkb in the white state is smaller than that in the black state.

The liquid crystal capacitance Clc in the black state influenced by the horizontal dielectric constant $\in$II is smaller than that in the white state influenced by the vertical dielectric constant $\in\perp$, and the kickback voltage Vkb in the black state is larger than that in the white state Since the kickback voltage Vkb varies according to the gray level, optical common voltages, which are defined by an arithmetic mean value of the positive pixel voltage formed by the positive data voltage and the negative pixel voltage formed by the negative data voltage, are different from each other. Meanwhile, an actual common voltage Vcom may be calculated through an experiment in a halftone gray. Due to a deviation between the optimal common voltage generated by the kickback voltage Vkb and the actual common voltage Vcom, the pixel voltages when the positive data voltage is applied and when the negative data voltage is applied are different from each other, and as result, a flicker and an afterimage are generated.

Accordingly, in order to compensate for the optimal common voltage Vcom for each gray level which is changed by the kickback voltage Vkb, the data voltage for each gray level may be compensated in advance by considering the kickback voltage Vkb. Hereinafter, a method of compensating for the data voltage for each gray by considering the kickback voltage will be described with reference to FIGS. 7A and 7B.

Figure 7A:
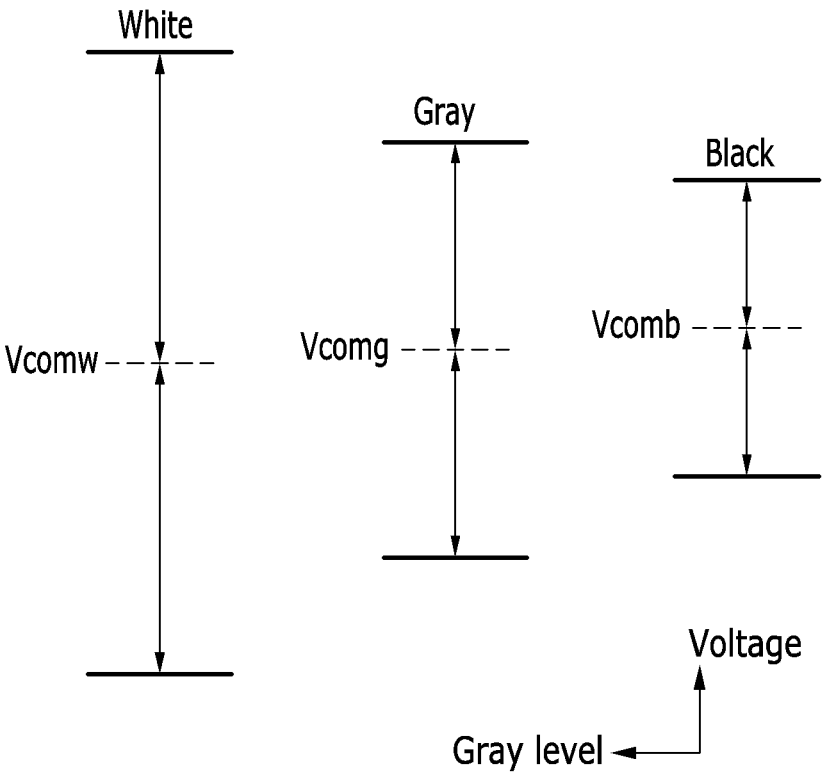
FIG. 7A and FIG. 7B are graphs illustrating an example of a process of optimizing a data voltage applied to a pixel by asymmetrical gamma correction.
Figure 7B:
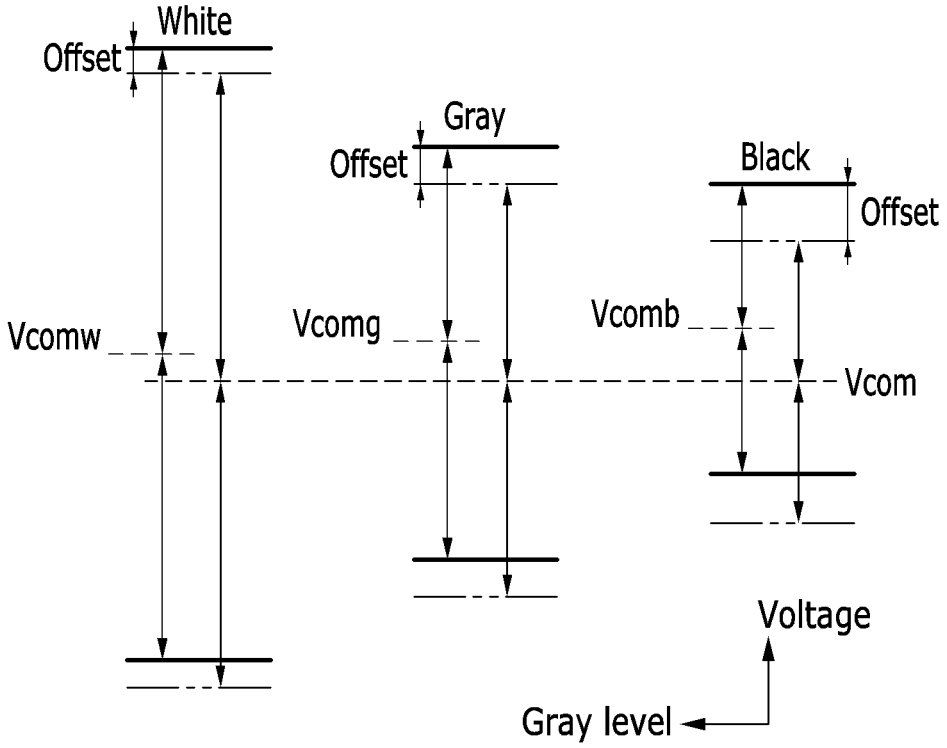

FIGS. 7A and 7B are a graph illustrating an example of a process of optimizing a data voltage applied to a pixel by asymmetrical gamma correction.

Referring to FIG. 7A, by a change in the liquid crystal capacitance Clc according to a gray level, in a normally black mode, the kickback voltage Vkb is large in a black gray (Black) and small in a white gray (White). By the kickback voltage Vkb, as illustrated in FIG. 7A, optimal common voltages Vcomw, Vcomg, and Vcomb for White, a halftone gray (Gray), and Black are different from each other. That is, the optimal common voltages for each gray level are different from each other.

As illustrated in FIG. 7B, when the data voltage for each gray level is compensated by applying an offset value in advance according to the kickback voltage Vkb, the optimal common voltages Vcom for each gray level may be equally made. In this case, the compensated offset value for each gray level is decreased toward the White from the Black. The offset value corresponds to the value of the kickback voltage Vkb for each gray level.

When the data voltage for each gray level is compensated by the asymmetrical gamma correction, the DC afterimage may be improved. However, the AC afterimage may still become a problem. Particularly, in the PLS mode liquid crystal display using the light alignment layer, the main cause of the afterimage other than the DC afterimage is the AC afterimage.

Figure 8A:
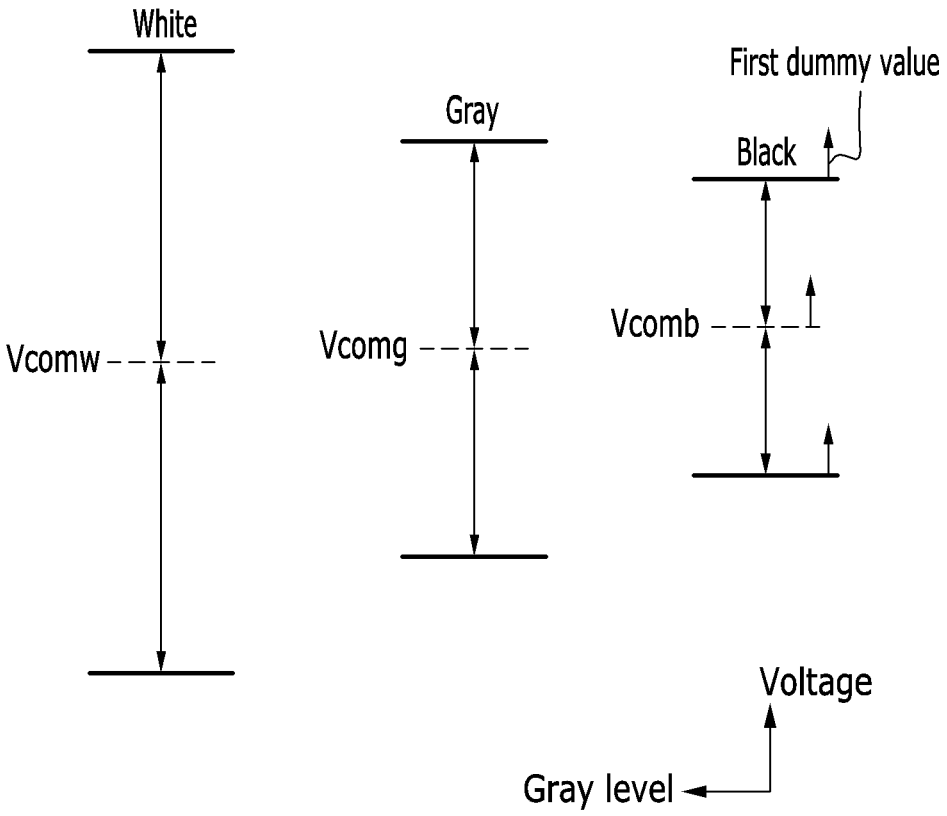
FIG. 8A and FIG. 8B are graphs illustrating another example of the process of optimizing the data voltage applied to the pixel by asymmetrical gamma correction.
Figure 8B:
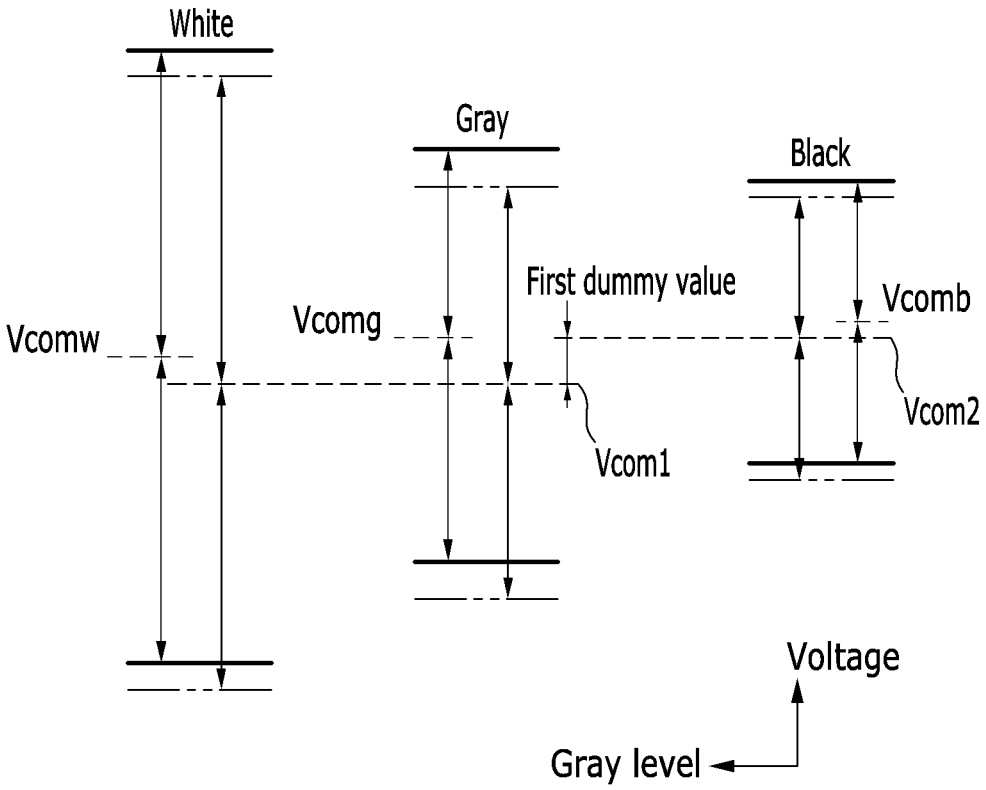

FIGS. 8A and 8B are graphs illustrating another example of the process of optimizing the data voltage applied to the pixel by asymmetrical gamma correction.

Referring to FIG. 8A, when the data voltage for each gray level is compensated by applying an offset value in advance according to the kickback voltage Vkb, as illustrated in FIG. 8A, a first dummy value is additionally compensated in Black. In this case, the compensated value in Black may be a first value obtained by adding the first dummy value to the offset value of Black.

As illustrated in FIG. 8B, the common voltage which is actually applied to the liquid crystal display is the optimal common voltage Vcom1 for White and the halftone Gray. On the other hand, the optimal common voltage Vcom2 of Black may be higher than the actual common voltage by the first dummy value. As a result, when the afterimage is generated by continuously displaying the image with the check pattern including the black region and the white region, in a black region in which the image of Black is displayed, the residual DC voltage may be accumulated. By the accumulated residual DC voltage in the black region, there is an effect that the AC afterimage generated on a boundary of the black region in which the Black image is displayed and the white region in which the White image is displayed is improved.

When exemplifying the graph of FIG. 6, the luminance change rate curve (●) for Black after the check pattern is displayed for 1 hour by the residual DC voltage accumulated in the black region moves to a right side, the luminance difference between Black and White at the actual common voltage of 0 V is reduced, and as a result, there is an effect that the AC afterimage is decreased.

However, there is vulnerability that the AC afterimage generated on a boundary of a gray region in which the halftone Gray image is displayed and the white region in which the White image is displayed is not compensated.

Figure 9A:
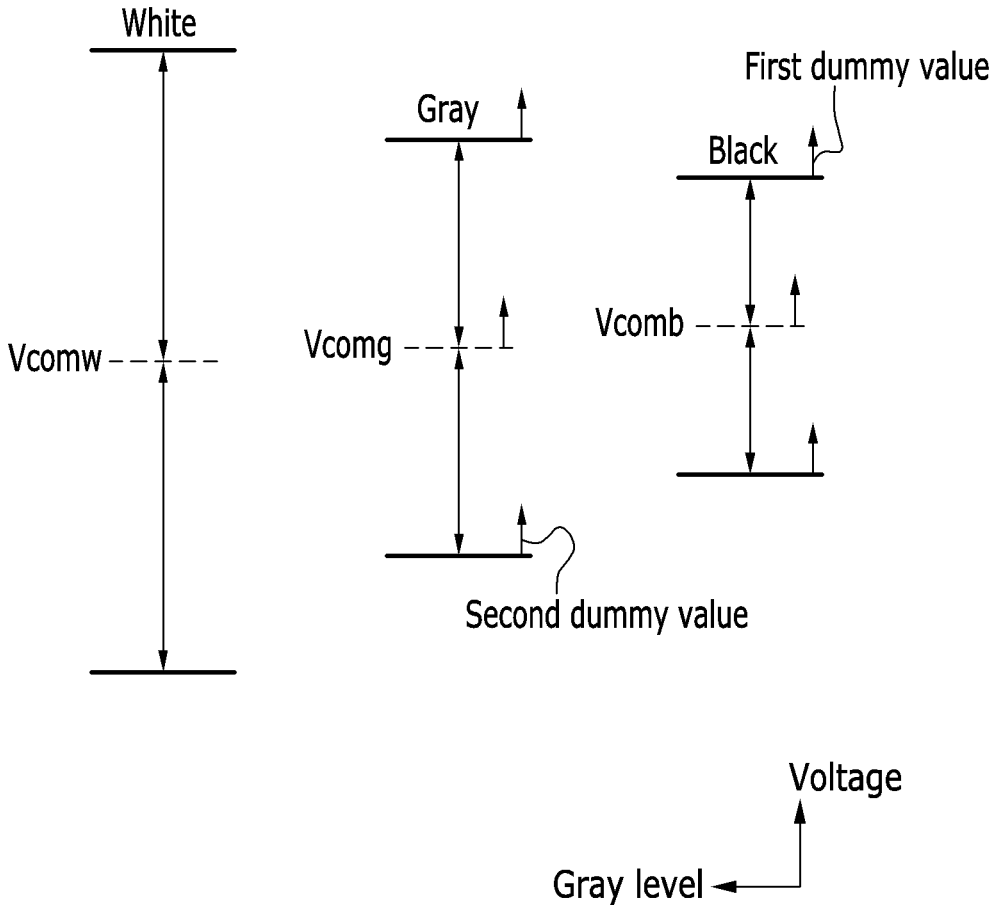
FIG. 9A and FIG. 9B are graphs illustrating a process of optimizing a data voltage applied to a pixel by asymmetrical gamma correction according to an exemplary embodiment of the present invention.
Figure 9B:
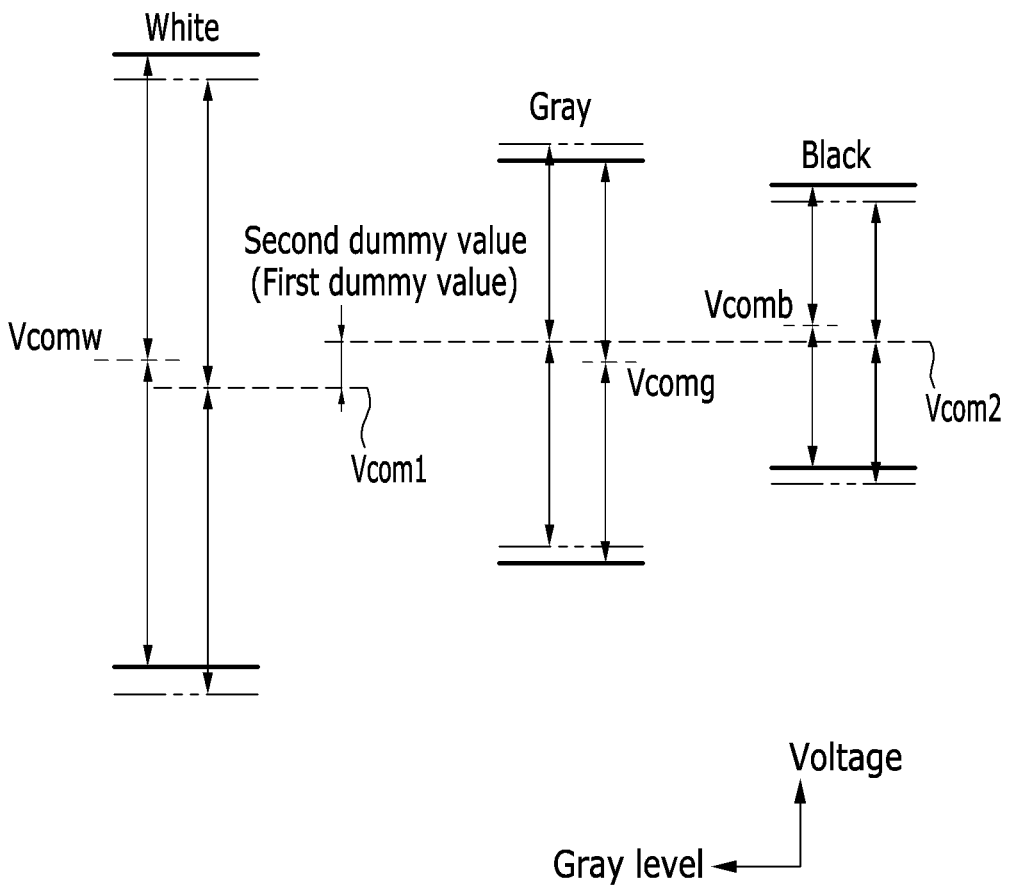

FIGS. 9A and 9B are graphs illustrating a process of optimizing a data voltage applied to a pixel by asymmetrical gamma correction according to an exemplary embodiment of the present invention.

Referring to FIG. 9A, when the data voltage for each gray level is compensated by applying an offset value in advance according to the kickback voltage Vkb, as illustrated in FIG. 9A, the first dummy value is additionally compensated in Black and a second dummy value is additionally compensated in the halftone Gray. In this case, the compensated value in Black is the first value obtained by adding the first dummy value to the offset value of Black, and the compensated value in the halftone Gray may be a second value obtained by adding the second dummy value to the offset value of the halftone Gray. In this case, a third value compensated in White, as an offset value of White, is obtained by reflecting only the kickback voltage Vkb of White. As a result, by the asymmetrical gamma correction, the data voltage of Black is shifted from an original data voltage of Black by the first value, the data voltage of the halftone Gray is shifted from an original data voltage of the halftone Gray by the second value, and the data voltage of White is shifted from an original data voltage of White by the third value.

The first dummy value and the second dummy value may have a range of −20 mV to −100 mV or 20 mV to 100 mV. The first dummy value and the second dummy value may become the same value. However, the first dummy value and the second dummy value are not necessarily the same value.

As illustrated in FIG. 9B, the common voltage which is actually applied to the liquid crystal display is the optimal common voltage Vcom1 for White. On the other hand, the optimal common voltages Vcom2 of Black and Gray are higher than the actual common voltage by the first dummy value. As a result, when the afterimage is generated by continuously displaying a test image including the black region, the gray region, and the white region, even in the black region in which the Black image is displayed and the halftone gray region in which the Gray image is displayed, the residual DC voltage may be accumulated. By the accumulated residual DC voltage in the black region and the gray region, there is an effect that the AC afterimages generated on the boundary of the black region and the white region and the boundary of the gray region and the white region are also improved.

As such, when the data voltage is corrected by the asymmetrical gamma correction, the first dummy value and the second dummy value are additionally compensated in Black and Gray to improve the AC afterimage when the Black image and the Gray image are displayed.

Meanwhile, the liquid crystal display may be continuously driven at room temperature and at a high temperature according to a temperature condition. Accordingly, it is necessary to continuously evaluate the afterimage at the room temperature and at the high temperature. A method of continuously evaluating the afterimage of the liquid crystal display at the room temperature and the high temperature will be described with reference to FIG. 10. The room temperature may be approximately 20° C. as a temperature lower than 40° C., and the high temperature may be approximately 60° C. as a temperature of 40° C. or more.

Figure 10:
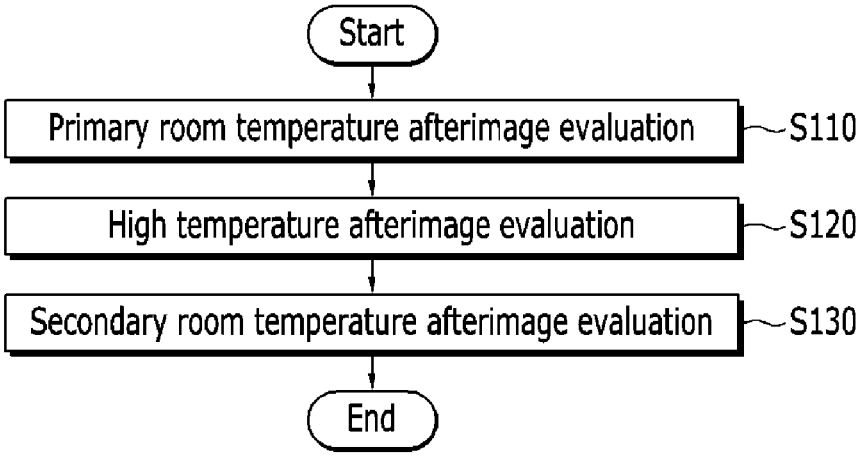
FIG. 10 is a flowchart illustrating a process of evaluating an afterimage of the liquid crystal display according to an exemplary embodiment of the present invention.

FIG. 10 is a flowchart illustrating a process of evaluating an afterimage of the liquid crystal display according to the exemplary embodiment of the present invention. It is assumed that the liquid crystal display uses an asymmetrical gamma correction method which may improve the AC afterimage even when the Black image and the Gray image are displayed like FIG. 9.

Referring to FIG. 10, after a test image including the black region, the gray region, and the white region is displayed for a predetermined time at the room temperature, a primary room temperature afterimage evaluation is performed (S110). The primary room temperature afterimage evaluation is performed by a method of evaluating a level of the afterimage by displaying a predetermined halftone gray image immediately after the test image is displayed for the predetermined time at the room temperature. When the level of the afterimage is divided into 0 to 5, in the case where the level of the afterimage is 2 or less, an afterimage specification of the liquid crystal display may be satisfied. As described above in FIG. 9, when the Black image and the Gray image are displayed, the AC afterimage may be improved, and as a result, the afterimage specification may be satisfied. That is, the primary room temperature afterimage may be improved.

Immediately after the primary room temperature afterimage evaluation, after a check pattern including the black region and the white region at the high temperature is displayed for a predetermined time, a high temperature afterimage evaluation is performed (S120). The high temperature afterimage evaluation is performed by a method of evaluating a level of the afterimage by displaying a predetermined halftone gray image immediately after the check pattern is displayed for the predetermined time at the high temperature. Even in the high temperature afterimage evaluation, the residual DC voltage may be accumulated in the black region and the afterimage specification may be satisfied. That is, the high temperature afterimage may be improved.

Immediately after the high temperature afterimage evaluation, after a test image including the black region, the gray region, and the white region is displayed for a predetermined time at the room temperature, a secondary room temperature afterimage evaluation is performed (S130). The secondary room temperature afterimage evaluation is performed by the same method as the primary room temperature afterimage evaluation. Since the residual DC voltage accumulated in the black region is large in the high temperature afterimage evaluation, in the secondary room temperature afterimage evaluation, the residual DC voltage is not accumulated at all in the black region. Since the residual DC voltage is not accumulated in the black region, the afterimage improvement effect by the asymmetrical gamma correction described above in FIG. 9 may not be obtained. Accordingly, in the secondary room temperature afterimage evaluation, the afterimage is generated. That is, the secondary room temperature afterimage is generated.

Hereinafter, a method of improving the primary room temperature afterimage, the high temperature afterimage, and the secondary room temperature afterimage will be described with reference to FIGS. 11 and 12.

Figure 11:
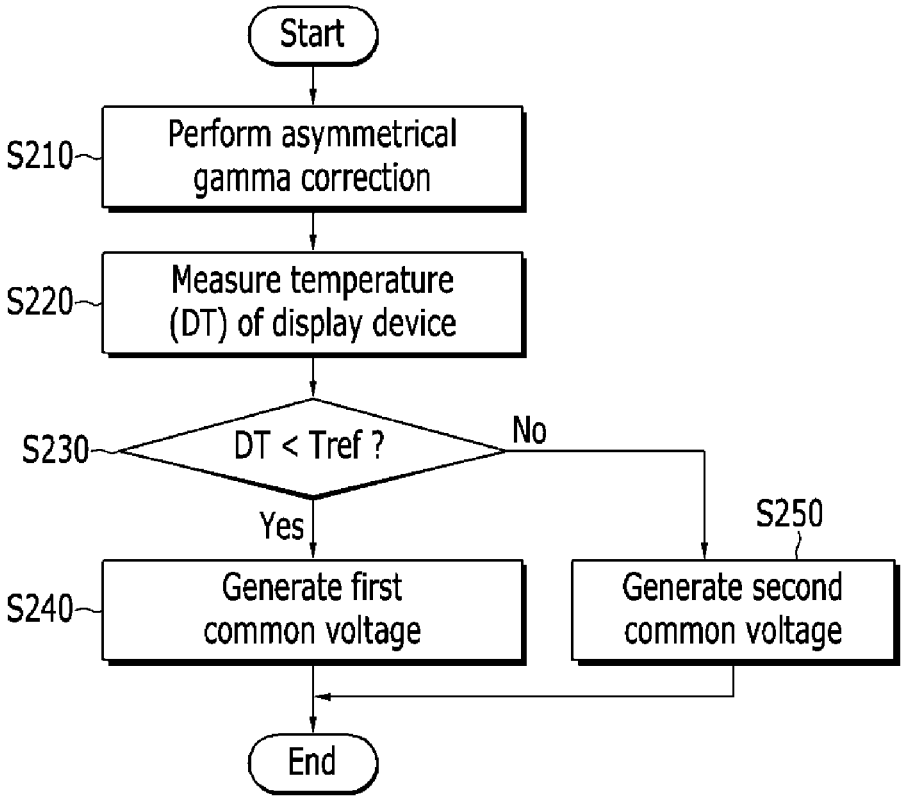
FIG. 11 is a flowchart illustrating a driving method of the liquid crystal display according to an exemplary embodiment of the present invention.

FIG. 11 is a flowchart illustrating a driving method of the liquid crystal display according to the exemplary embodiment of the present invention. FIG. 12 is a graph illustrating a process of setting a common voltage according to a temperature of the liquid crystal display when a data voltage applied to a pixel is optimized by asymmetrical gamma correction. FIG. 12 optimizes the data voltage according to the asymmetrical gamma correction method of FIG. 9.

Figure 12:
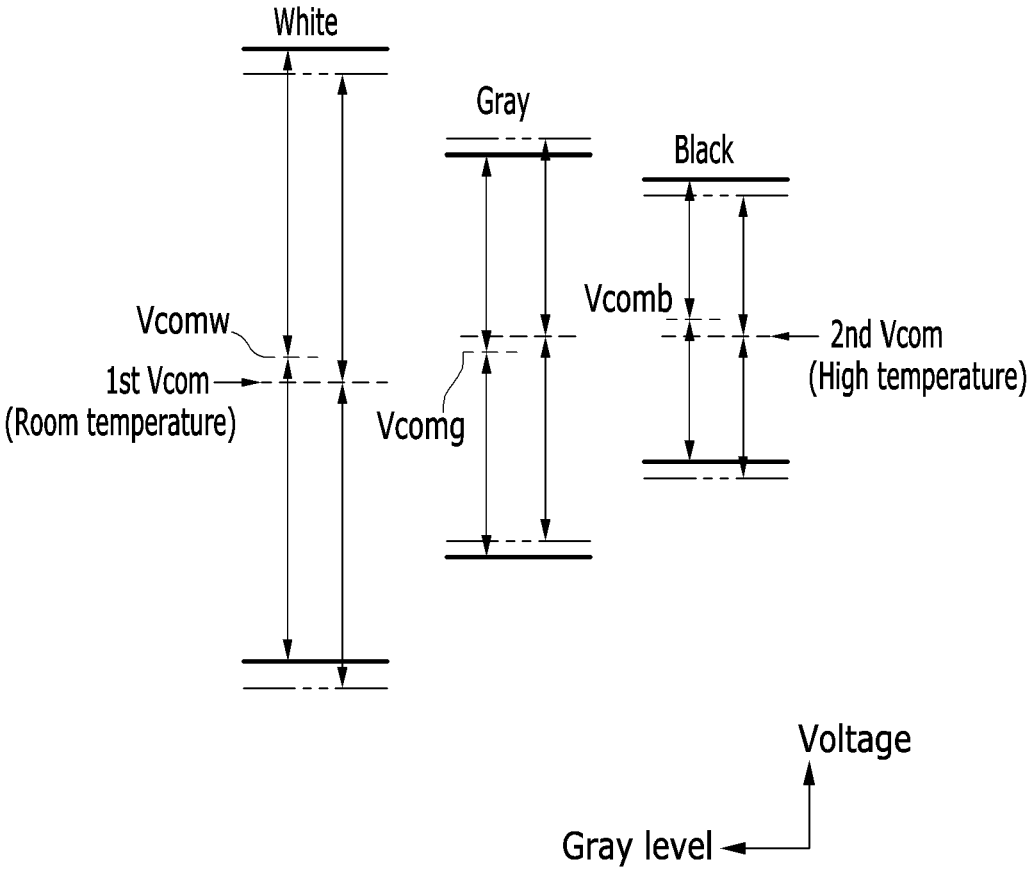
FIG. 12 is a graph illustrating a process of setting a common voltage according to a temperature of the liquid crystal display when a data voltage applied to a pixel is optimized by asymmetrical gamma correction according to an exemplary embodiment of the present invention.

Referring to FIGS. 11 and 12, the signal controller 1100 performs the asymmetrical gamma correction method described in FIG. 9 (S210). The signal controller 1100 corrects image signals R, G, and B according to the asymmetrical gamma correction method to generate an image data signal DAT, and as a result, the data voltage may be compensated. That is, the data voltage of Black is shifted from an original data voltage of Black by the first value, the data voltage of Gray is shifted from an original data voltage of Gray by the second value, and the data voltage of White is shifted from an original data voltage of White by the third value. The first value is a value obtained by adding the first dummy value to the first offset value corresponding to the kickback voltage of the data voltage of Black, the second value is a value obtained by adding the second dummy value to the second offset value corresponding to the kickback voltage of the data voltage of Gray, and the third value is a third offset value corresponding to the kickback voltage of the data voltage of White. The first dummy value and the second dummy value may be the same as each other or different from each other.

Meanwhile, the signal controller 1100 stores the image signals R, G, and B for a predetermined time and may verify afterimage driving when it is verified that a still image is continuously displayed. The afterimage driving means driving of the liquid crystal display for suppressing the afterimage when the still image is continuously displayed for a predetermined time or more. In some cases, a process of verifying the afterimage driving may also be omitted.

The temperature sensor unit 1600 measures a temperature DT of the display device (S220). That is, the temperature sensor unit 1600 measures a temperature of the liquid crystal panel assembly 1500. The measured temperature is transferred to the common voltage generator 1700.

The common voltage generator 1700 determines whether the temperature DT of the display device is lower than a reference temperature Tref (S230). The reference temperature Tref may be determined as approximately 40° C. as a temperature which is a reference for dividing the room temperature and the high temperature. The reference temperature Tref is not limited, and the reference temperature Tref for dividing the room temperature and the high temperature may be variously determined.

When the temperature DT of the display device is lower than the reference temperature Tref, the common voltage generator 1700 generates the first common voltage 1st Vcom (S240). The first common voltage 1st Vcom is applied to the liquid crystal panel assembly 1500. That is, at the room temperature, the first common voltage 1st Vcom is applied to the liquid crystal panel assembly 1500. The first common voltage 1st Vcom is the optimal common voltage for the data voltage of White in the asymmetrical gamma correction.

When the temperature DT of the display device is higher than or equal to the reference temperature Tref, the common voltage generator 1700 generates the second common voltage 2nd Vcom (S250). The second common voltage 2nd Vcom is applied to the liquid crystal panel assembly 1500. That is, at the high temperature, the second common voltage 2nd Vcom is applied to the liquid crystal panel assembly 1500. The second common voltage 2nd Vcom is the optimal common voltage for the data voltage of Black or Gray in the asymmetrical gamma correction. The second common voltage 2nd Vcom may be higher than the first common voltage 1st Vcom by the first dummy value or the second dummy value.

As such, at the room temperature, the first common voltage 1st Vcom which is the optimal common voltage for White is applied to the liquid crystal panel assembly 1500 as an actual common voltage, and at the high temperature, the optimal common voltage for Black or Gray is applied to the liquid crystal panel assembly 1500 as an actual common voltage, thereby improving the secondary room temperature afterimage as well as the primary room temperature afterimage and the high temperature afterimage.

In FIG. 10, when the high temperature afterimage evaluation is performed, the second common voltage 2nd Vcom is applied to the liquid crystal panel assembly 1500, and as a result, the residual DC voltage may not be accumulated in the black region. In the high temperature afterimage evaluation, the residual DC voltage is not accumulated in the black region, and as a result, in the secondary room temperature afterimage evaluation, the residual DC voltage is accumulated in the black region, and the afterimage improvement effect by the asymmetrical gamma correction described above in FIG. 9 may be obtained. That is, in the secondary room temperature afterimage evaluation, the afterimage specification may be satisfied.

Hereinafter, in FIGS. 13 and 14, experimental results of the secondary room temperature afterimage evaluation and the high temperature afterimage evaluation of the liquid crystal display which uses the first common voltage 1st Vcom and the second common voltage 2nd Vcom at the room temperature and the high temperature like FIG. 12 while using the asymmetrical gamma correction method according to the present invention will be described. The liquid crystal display used in the experiment is a PLS mode liquid crystal display using the light alignment layer. The first dummy value and the second dummy value for Black and Gray were set to +55 mV.

Figure 13:
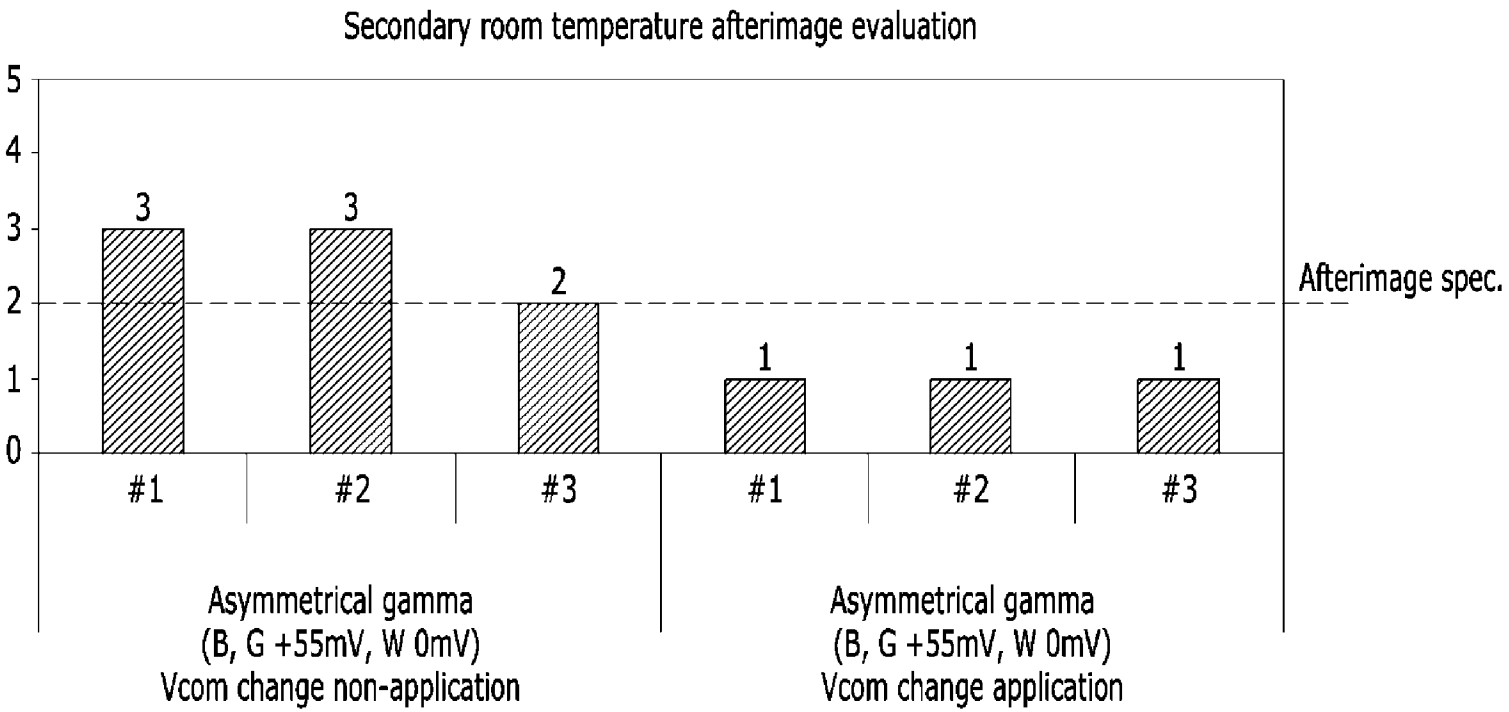
FIG. 13 is a graph illustrating a secondary room temperature afterimage evaluation result in comparison with a case where the common voltage is not changed in the liquid crystal display according to an exemplary embodiment of the present invention.

FIG. 13 is a graph illustrating a comparison of a secondary room temperature afterimage evaluation result with a case where the common voltage is not changed in the liquid crystal display according to the exemplary embodiment of the present invention.

Referring to FIG. 13, in the case of Vcom change non-application of using only the asymmetrical gamma correction method of FIG. 9 and using only the optimal common voltage Vcom for White without changing the actual common voltage according to the temperature of the display device, in the secondary room temperature afterimage evaluation, the afterimage level is shown as 2 or more which is the afterimage specification.

According to the present invention, in the case of Vcom change application of using the asymmetrical gamma correction method of FIG. 9 and changing the actual common voltage according to the temperature of the display device, in the secondary room temperature afterimage evaluation, the afterimage level is shown as less than 2 which is the afterimage specification. That is, it can be seen that the secondary room temperature afterimage may be improved.

Figure 14:
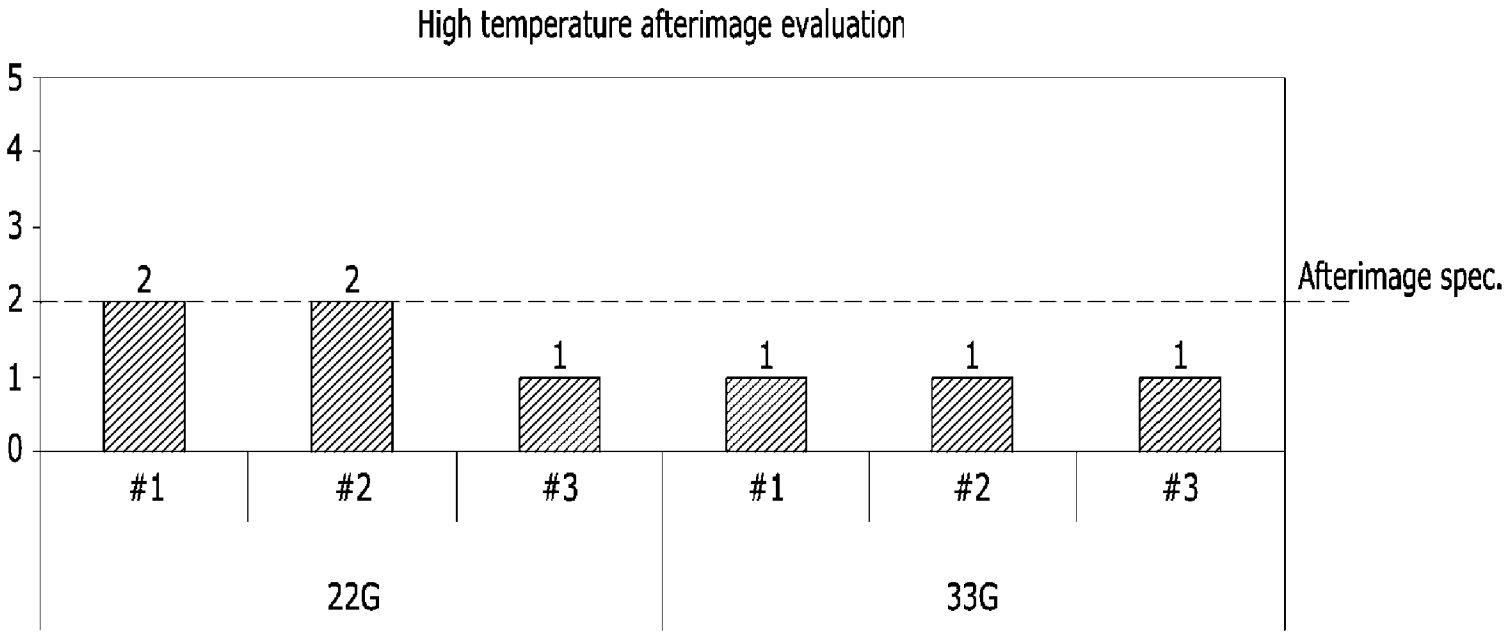
FIG. 14 is a graph illustrating a high temperature afterimage evaluation result in the liquid crystal display according to an exemplary embodiment of the present invention.

FIG. 14 is a graph illustrating a high temperature afterimage evaluation result in the liquid crystal display according to the exemplary embodiment of the present invention.

Referring to FIG. 14, the asymmetrical gamma correction method according to the present invention was used, and at the high temperature, the second common voltage 2nd Vcom was used. At a high temperature of 60° C., immediately after the check pattern is displayed for a predetermined time, images of 22 grays and 33 grays were displayed and then the level of the afterimage was evaluated. Even in the high temperature evaluation, it is shown that the afterimage level is 2 or less which is the afterimage specification, and it can be seen that the high temperature afterimage is not a problem.

According to the exemplary embodiment of the present invention, it is possible to improve an afterimage in the liquid crystal display.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A liquid crystal display, comprising:

a liquid crystal panel assembly comprising a plurality of pixels;

a signal controller configured to generate image data signals so that among data voltages applied to the plurality of pixels, a first data voltage is shifted from a first original data voltage by a first value, a second data voltage is shifted from a second original data voltage by a second value, and a third data voltage is shifted from a third original data voltage by a third value; and a data driver configured to apply the data voltages to a plurality of data lines connected to the plurality of pixels, wherein the first value is a value obtained by adding a first dummy value to a first offset value corresponding to a kickback voltage of the first data voltage, the second value is a value obtained by adding a second dummy value to a second offset value corresponding to a kickback voltage of the second data voltage, and the third value is a third offset value corresponding to a kickback voltage of the third data voltage.

2. The liquid crystal display of claim 1, wherein an optimal common voltage for the first data voltage or the second data voltage is configured to be higher than an optimal common voltage for the third data voltage by the first dummy value or the second dummy value.

3. The liquid crystal display of claim 2, wherein the kickback voltage of the second data voltage is configured to be larger than the kickback voltage of the third data voltage, and the kickback voltage of the first data voltage is configured to be larger than the kickback voltage of the second data voltage.

4. The liquid crystal display of claim 1, wherein the second offset value is configured to be larger than the third offset value, and the first offset value is configured to be larger than the second offset value.

5. The liquid crystal display of claim 4, wherein the first dummy value and the second dummy value are the same as each other.

6. The liquid crystal display of claim 4, wherein the first dummy value and the second dummy value are different from each other.

7. The liquid crystal display of claim 1, wherein:

the liquid crystal panel assembly comprises:

a first substrate;

a thin film transistor disposed on the first substrate;

a first electrode connected to the thin film transistor; and a first alignment layer disposed on the first electrode; and the first alignment layer comprises a copolymer selected from the group consisting of cyclobutanedianhydride (CBDA) and a combination of a CBDA derivative and diamine.

8. The liquid crystal display of claim 7, wherein:

the liquid crystal panel assembly further comprises:

a second electrode disposed on the first substrate; and an insulating layer disposed between the first electrode and the second electrode; and the first electrode comprises a plurality of branch electrodes, and the second electrode has a planar shape.

9. The liquid crystal display of claim 8, wherein the plurality of branch electrodes overlap with the second electrode having the planar shape.

10. A driving method of a liquid crystal display, comprising:

shifting a first data voltage from a first original data voltage by a first value, shifting a second data voltage from a second original data voltage by a second value, and shifting a third data voltage from a third original data voltage by a third value, among data voltages;

applying the data voltages to a plurality of data lines connected to a plurality of pixels, wherein the first value is a value obtained by adding a first dummy value to a first offset value corresponding to a kickback voltage of the first data voltage, the second value is a value obtained by adding a second dummy value to a second offset value corresponding to a kickback voltage of the second data voltage, and the third value is a third offset value corresponding to a kickback voltage of the third data voltage.

11. The method of claim 10, wherein an optimal common voltage for the first data voltage or the second data voltage is generated to be higher than an optimal common voltage for the third data voltage by the first dummy value or the second dummy value.

12. The method of claim 10, wherein the kickback voltage of the second data voltage is larger than the kickback voltage of the third data voltage, and the kickback voltage of the first data voltage is larger than the kickback voltage of the second data voltage.

13. The method of claim 10, wherein the second offset value is larger than the third offset value, and the first offset value is larger than the second offset value.

14. The method of claim 13, wherein the first dummy value and the second dummy value are the same as each other.

15. The method of claim 13, wherein the first dummy value and the second dummy value are different from each other.

* * * * *